United States Patent [19]

Roll et al.

[11] Patent Number: 4,857,810

[45] Date of Patent: Aug. 15, 1989

[54] CURRENT INTERRUPTION OPERATING CIRCUIT FOR A GASEOUS DISCHARGE LAMP

[75] Inventors: Kenneth A. Roll, Kirtland; John M. Davenport, Lyndhurst; Pieter J. von Herrmann, Shaker Heights, all of Ohio

[73] Assignee: General Electric Company, Schenectady, N.Y.

[21] Appl. No.: 26,808

[22] Filed: Mar. 17, 1987

[51] Int. Cl.[4] ..... H05B 41/36

[52] U.S. Cl. ..... 315/194; 315/307

[58] Field of Search ..... 315/306, 307, 194, DIG. 4, 315/DIG. 7

[56] References Cited

U.S. PATENT DOCUMENTS 3,771,013 11/1973 Roche et al. .

4,358,716 11/1982 Cordes et al. ..... 315/194

4,560,908 12/1985 Stupp et al. ..... 315/219

OTHER PUBLICATIONS

Waymouth, John F., "Current Runaway in Fluorescent Lamps", *Journal of IES*, Oct. 1972, pp. 43–49.

*Primary Examiner*—Robert L. Griffin

*Assistant Examiner*—T. Salindong

*Attorney, Agent, or Firm*—John P. McMahon; Stanley C. Corwin; Fred Jacob

[57] ABSTRACT

A power supply system for discharge lamps employs a current interruption circuit to control current flow through a discharge lamp. A power switch is connected in series with the lamp and controls the current level in the lamp by controlling lamp current on-time. The current on-time is maintained for a relatively very short time period allowing control of lamp current by controlling the integral of the lamp current or controlling the charge delivered to the lamp during each pulse rather than controlling peak current value. Since the voltage impressed across the lamp generally exceeds the conventional value observed when using a passive current limiting means, for example a series reactor, non radiative losses associated with operating the lamp are reduced.

22 Claims, 5 Drawing Sheets

CURRENT INTERRUPTION OPERATING CIRCUIT FOR A GASEOUS DISCHARGE LAMP

BACKGROUND OF THE INVENTION

Introduction

1. Field of the Invention

The present invention relates to operating circuits for gaseous discharge lamps and, more particularly, to a circuit and method for operating a gaseous discharge lamp by controllably interrupting lamp current.

2. Description of the Prior Art

A low pressure mercury vapor discharge lamp, such as a fluorescent lamp, is an electrical device which exhibits certain special electrical characteristics, among them is a negative impedance characteristic which means that after the arc condition of the lamp has been struck or established, increased current through the discharge medium within the lamp results in decreased voltage between the electrodes of the lamp. Due to this characteristic of discharge lamp operation, it has been necessary to provide circuitry for current limitation in power supply circuits for operating discharge lamps. If current limitation is not provided, lamp failure or burn-out of the power supply circuit generally results. Therefore, the prior art has typically provided electrical impedance elements connected in series with the fluorescent lamp for current control.

U.S. Pat. No. 3,771,013, issued Nov. 6, 1973 to Roche et al describes a lighting system which employs a static d-c power supply circuit to operate fluorescent lamps. The Roche et al patent describes a fluorescent lamp power supply circuit for operating a specially designed lamp on d-c power within the positive region of its volt-ampere characteristic. The source voltage applied to the lamp is reduced in the event that the lamp is operated outside of the positive region of its volt-ampere characteristic which is sensed when a predetermined maximum current has been reached, so that the current supplied to the lamp is monitored and maintained below a predetermined maximum current level at which runaway or damage of the lamp could occur. An analysis of fluorescent lamp runaway is presented in the paper titled, "Current Runaway in Fluorescent Lamps", which appeared in the *Journal of IES,* October 1972, by John F. Waymouth. The analysis in that paper concludes that in response to the application of d-c voltage V, see FIG. 2*a* of the present application, current takes an initial "instantaneous" step to $i_1$ in about 2 microseconds and then increases exponentially with time as shown in FIG. 2*b* of the present invention. Given this analysis, it was considered necessary to clip the lamp current at a certain predetermined level to prevent current runaway and destruction of the lamp. The analysis in the paper of Waymouth states on page 43, right hand column, lines 13–16, that "the circuitry problem is that for any current greater than zero and voltages equal to $V_S$, the *starting voltage* [emphasis in original] of the discharge, all V, and i points are in the domain of $$\frac{dne}{dt} > 0,$$

hence current increases steadily with time until destruction," in which dne/dt represents the time rate of change of electron density. Waymouth controlled the lamp current level by cutting off the lamp power supply circuit before lamp current reached a predetermined level (Page 46, left column, lines 1–6).

SUMMARY OF THE INVENTION

An object of the present invention is to provide a power supply circuit for a discharge lamp which provides a constant charge to the lamp. A more specific object of the present invention is to provide a switching circuit for a power supply for a discharge lamp which controls the on-time of the lamp.

The invention comprises briefly, and in a preferred embodiment, a fluorescent lamp operating circuit comprising a diode bridge having its input or a-c side connected in series with the lamp, a solid state power switch connected across the output or d-c side of the diode bridge, and a control circuit to regulate the duty cycle of the power switch so as to advantageously control the current supplied to the lamp.

BRIEF DESCRIPTION OF THE DRAWINGS

Further objects and advantages of the present invention, together with its organization, method of operation and the best mode contemplated may best be understood by reference to the following description taken in conjunction with the accompanying drawings in which.

DESCRIPTION OF THE PREFERRED EMBODIMENTS

Figure 1:
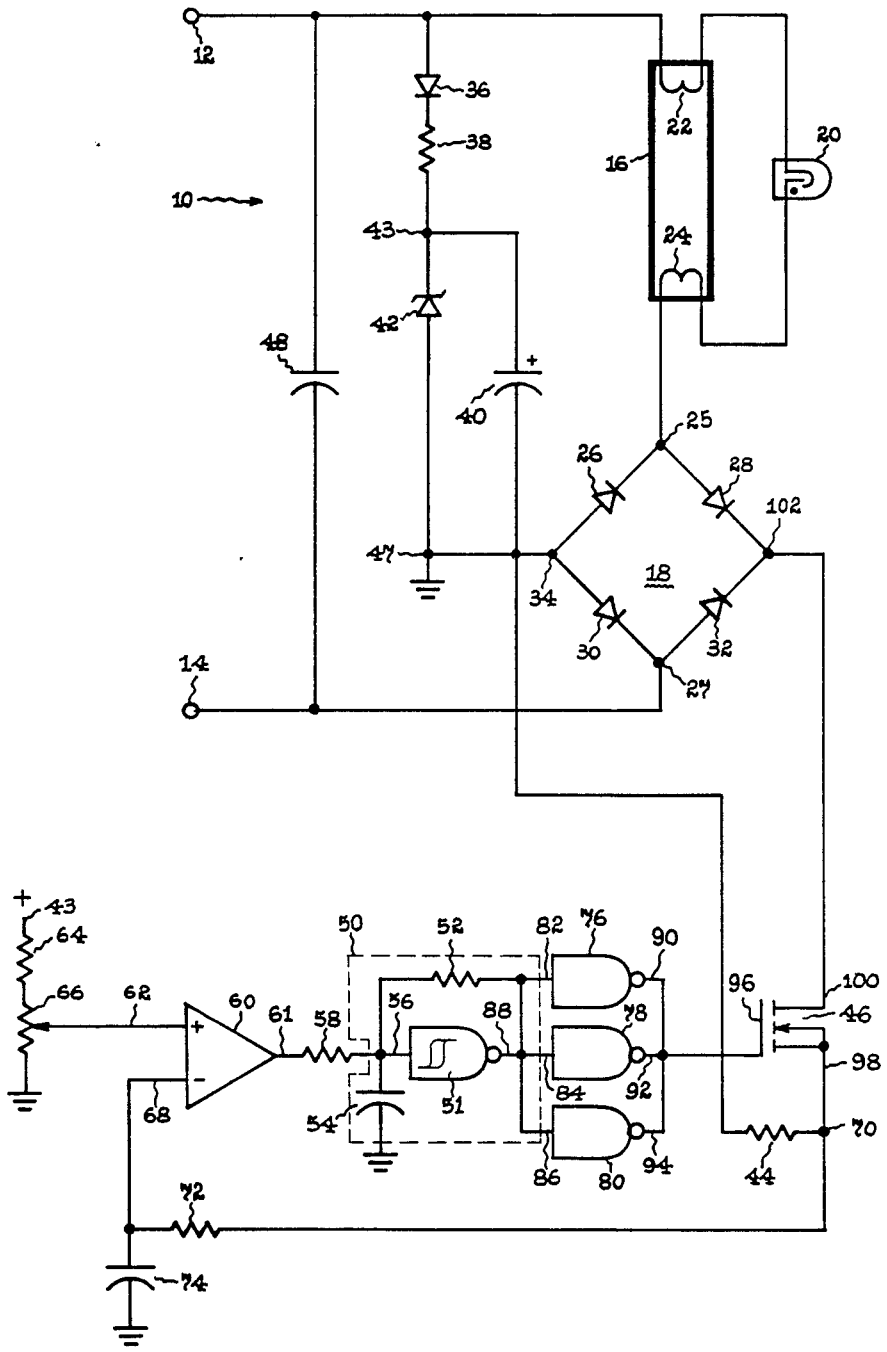
FIG. 1 is a schematic circuit diagram illustrating the power supply circuit of the present invention.

The constant current supply circuit 10 of the present invention as shown schematically in FIG. 1 includes terminals 12 and 14 for connection to a standard a-c source such as a 110 volt a-c power line. Low pressure mercury vapor discharge lamp 16, such as a fluorescent lamp, is connected in series with the input or a-c terminals 25 and 27 of a diode bridge 18 which, in turn, are connected across the a-c input terminals 12 and 14. A starting switch 20, such as a glow switch, is connected across the lamp 16 to control the supply of heating current to the lamp electrodes 22 and 24 of the lamp 16 prior to its starting. The diode bridge 18 consists of diodes 26, 28, 30 and 32 connected as shown.

A power supply circuit comprising diode 36, resistor 38, capacitor 40 and zener diode 42 which is connected between terminal 12 and grounded terminal 34, grounded as shown at 47, of the diode bridge 18 so as to supply a constant reference voltage for the control circuit for power switch 46 as described hereinafter. An input capacitor 48 is connected across the terminals 12 and 14 to protect the circuit components from transients that may be present on the power line. The bridge arrangement 18 shown in FIG. 1 as having one of its output or d.c. terminals connected to an A.C. power switch 46 allows the power switch 46, which is a d-c device, to switch an a-c current so as to control current flow to the lamp 16 and therefore the ionization charge within the lamp.

The duty cycle of the A.C. power switch 46, preferably a power MOSFET type, is controlled in order to maintain a nearly constant transfer charge through the lamp 16. The A.C. power switch 46 may also be an Insulated Gate Transistor (IGT) or Darlington device. The control circuit is comprised of an oscillator 50 composed of a gate 51, a resistor 52 and a capacitor 54. The gate 51 is an inverter having Schmidt type inputs, which causes the inverter to exhibit hysteresis; i.e., the output of the gate 51 is switched from a high level to low when the input voltage goes to a certain high level, but the output will not return to a high level until the input is reduced to a voltage level lower than that at which the first output transition from high to low occurred. This difference between the input voltage levels at which switching occurs is the hysteresis condition that is utilized in the oscillator circuit of the present invention. If capacitor 54 is in a discharged state, then the output voltage of the gate 51 will be high and will charge capacitor 54 through the path provided by resistor 52. Capacitor 54 will charge up until the positive-going switching threshold state of gate 51 is reached. At this point, the input to gate 51 at location 56 is switched high and the output voltage of the gate 51 will go low causing capacitor 54 to begin to discharge. Capacitor 54 continues to discharge until the negative switching threshold of gate 51 is reached, causing the output of gate 51 to go to its high state. The gate 51 then repeats the before given process. The oscillator circuit 50 will continue to oscillate with the capacitor 54 charging and discharging between the two thresholds, and the output of gate 51 switching between the level of the voltage and ground connected to the circuit element 51.

The input 56 of gate 51 is connected via resistor 58 to the output of an integrated circuit comparator 60. Comparator 60 has a first or positive input 62 connected to a voltage divider which includes resistors 64 and 66 connected to a reference voltage at point 43 so as to provide a reference voltage at input 62. The comparator 60 has a second or negative input 68 connected to an integrating capacitor 74 and to an junction 70, via resistor 72, formed by a resistor 44 and MOSFET 46.

The circuit for controlling the charge transfer through lamp 16 further comprises parallel-connected integrated circuit inverters 76, 78 and 80 which are connected at their respective inputs 82, 84 and 86 to an output 88 of oscillator 50, and are also connected at their respective output terminals 90, 92 and 94 to a gate element 96 of MOSFET 46. The source terminal 98 of power MOSFET 46 is connected to junction 70 and the drain terminal 100 of MOSFET 46 is connected to terminal 102. The power MOSFET 46 is so arranged so as to be connected across the d-c terminals 34 and 102 of diode bridge 18.

Figure 4:
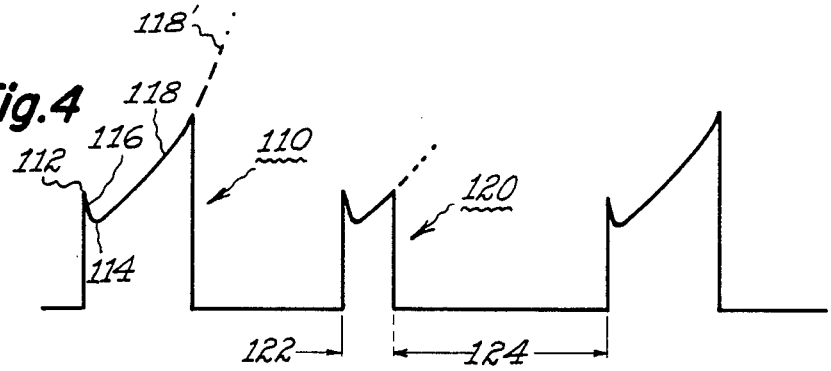
FIG. 4 is a waveform diagram illustrating the current induced in a fluorescent lamp by a voltage pulse.

The basic concept of operation of the present invention may be described with reference to the current flowing within the fluorescent lamp 16. The current flowing within the lamp 16 is interrupted before it has a chance to reach the runaway condition or portion of the lamp volt/ampere curve which allows run away, i.e., increases to a level adequate to damage or destroy the lamp. To accomplish such control, an appropriate off-time for the lamp is needed to allow deionization of the ionized medium in the lamp so as to balance charge carrier production occurring during the on-time of the lamp 16. We have discovered that for the current interrupt switching control circuit of FIG. 1 having an applied sinusoidal input across terminals 12 and 14 for use with a mercury low pressure discharge fluorescent lamp having an argon fill of approximately 2.0 Torr, it is desired to have a lamp current having waveforms 110 and 120 which are shown in FIG. 4.

Figure 2A:
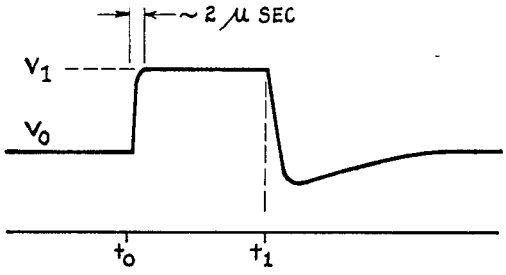
FIGS. 2*a* and 2*b* are voltage and current waveform diagrams, respectively, showing the prior art analysis of fluorescent lamp operation.
Figure 2B:
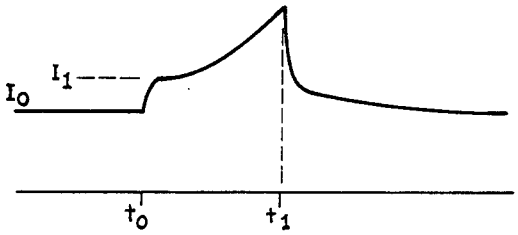

The lamp current flowing in lamp 16 initially increases rapidly to a high peak 112 and then declines quickly as shown at 116 to a minimum level 114 from which the current increases exponentially as shown at 118. If not interrupted the current level would increase into a run away condition, as shown by the dashed line 118', until the lamp fails. The positive resistance portion 116 of the waveform has a short but finite time duration on the order of 2–5 microseconds. This positive resistance portion 116 of the current waveform was not recognized by the prior art previously discussed with regard to FIG. 2*b*. During this time interval 116 no tendency toward current runaway is occurring. We have discovered that this positive resistance operating characteristic may be exploited to provide a desired lamp operating control. We produce, by appropriate control of the switching of lamp current, a series of current pulses 120 as shown in FIG. 4. Each pulse 120 includes the portion 116 of the current waveform 110 exhibiting a positive resistance characteristic and a portion 118 exhibiting the negative resistance characteristic, giving the pulse 120 a duration 122 of approximately one-fifth (1/5) to one-tenth (1/10) the duration 124 of the off-time related to lamp 116. By limiting the on-time to no more than the pulse duration 122, the control circuit maintains the ionization level of the lamp within a range which allows rapid lamp reignition without allowing current runaway.

Figure 5:
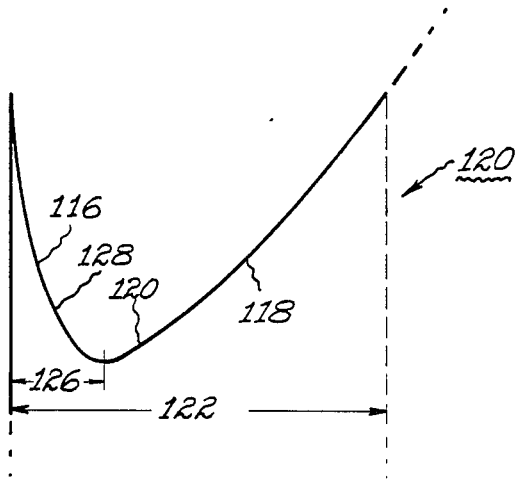
FIG. 5 is a waveform diagram illustrating the current waveform of FIG. 4 with an expanded time scale.

A preferred control is to limit the on-time pulse 120, shown in an enlarged manner in FIG. 5, to the interval 126 producing a waveform 128, having a reduced negative resistance portion 118, so that the lamp may be essentially operated as a positive resistance device. The circuit of the present invention allows accurate control of lamp on-time shown by pulse 120, and if the switching is accomplished so that this on-time is within a predetermined range, for example, less than 5 microseconds, regulation of the lamp may be done conveniently by controlling the pulse width 122 as with the oscillator circuit described hereinbefore. For such regulation, lamp illumination of the present invention then depends upon the charge delivered to the lamp rather than prior methods dependent upon the peak current supplied to the lamp.

The control circuit for driving MOSFET 46 so as to produce the desired waveforms shown in FIG. 5 operates such that, when the gate 96 receives a signal turning-on MOSFET 46, current passes through lamp 16 and the diode bridge rectifier 18 and a voltage is impressed across resistor 44 which is grounded at 47. The voltage across resistor 44 is applied to integrating capacitor 74 via resistor 72. Capacitor 74 provides an input voltage $V_C$, shown in FIG. 3*b*, to comparator 60 at the negative input 68.

Figure 3A:
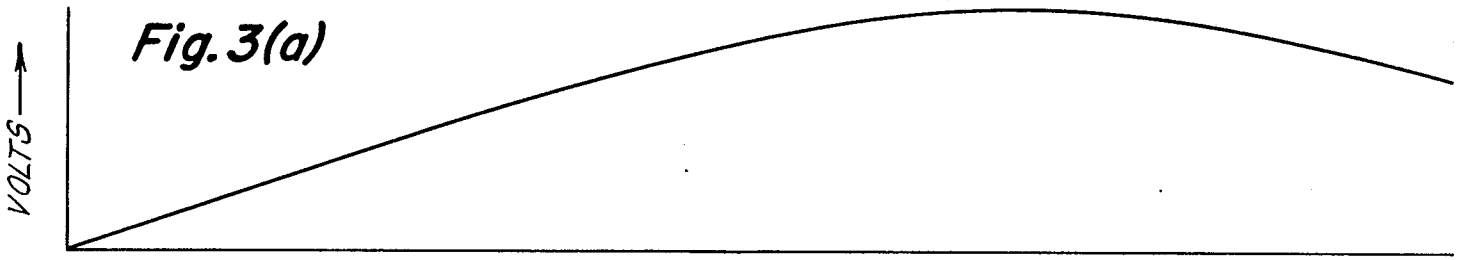
FIG. 3*a* is a waveform diagram illustrating a line voltage applied to the control circuit of the present invention.
Figure 3B:
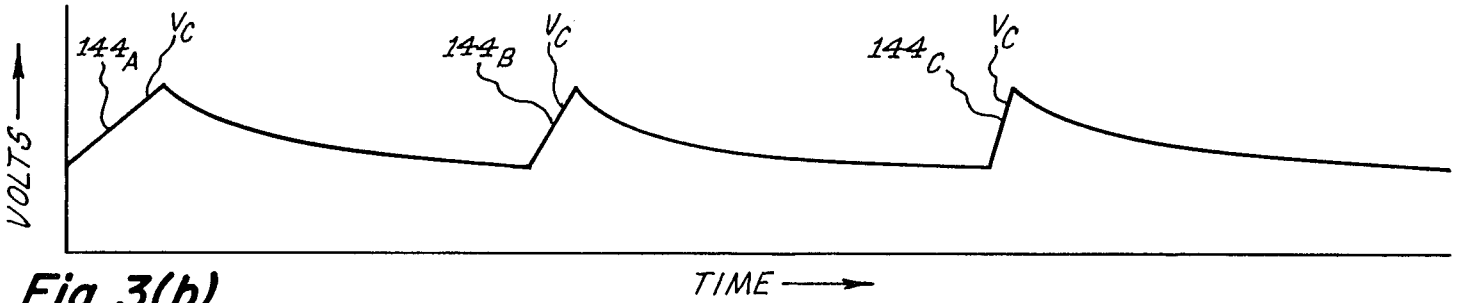
FIG. 3*b* is related to FIG. 3*a* and is a waveform diagram illustrating a control voltage input waveform for the control circuit of the present invention.
Figure 3C:
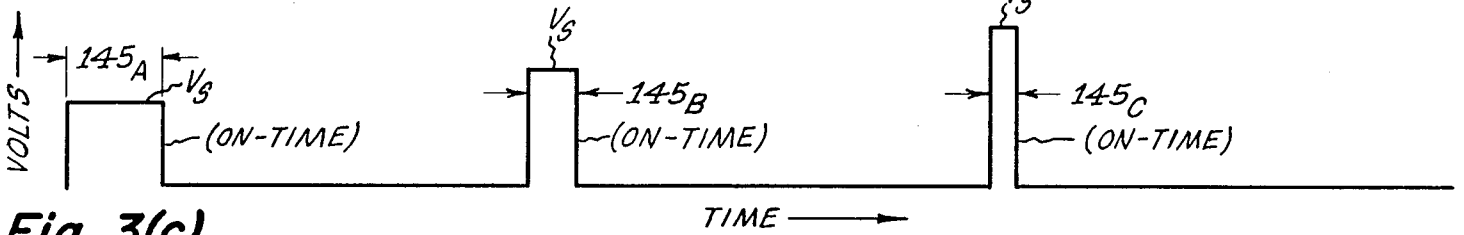
FIG. 3*c* is related to FIGS. 3*a* and 3*b* and is a waveform illustrating the output voltage of a control oscillator for driving the power switch of the present invention.

FIG. 3*b* along with FIGS. 3*a* and 3*c* comprise a family of interrelated waveforms. FIG. 3*a* illustrates a waveform of a portion of the first half-cycle of the line voltage of the applied a-c power source. FIG. 3*b* illustrates the waveform $V_C$ having various slopes $144_A$, $144_B$, and $144_C$ which increase as the amplitude of the waveform of FIG. 3*a* increases. Conversely, FIG. 3*c* illustrates waveforms $V_S$ having various durations $145_A$, $145_B$ and $145_C$ which decrease as the amplitude of waveform of FIG. 3*a* decreases.

The comparator 60 related to $V_C$ of FIG. 3*b* has a controllable reference voltage provided to its input 62 by the variable resistor 66. By adjusting the setting on resistor 66, the voltage level of the input 62 of comparator 60 can be selected to provide the proper switching voltage level for comparator 60 so as to control the switching level and therefore the on-time and off-time of oscillator 50, which, in turn, controls the on-time and off-time of MOSFET 46. The output 61 of comparator is connected to the input 56 of the oscillator 50 and controls the duty cycle of the oscillator 50. The oscillator 50 provides a generally square wave output to the inverters 76, 78 and 80, which, in turn, provides a square wave input $V_S$, shown in FIG. 3*c*, to the gate 96 of MOSFET 46. As the voltage applied to input 68 of comparator 60 by integrating capacitor 74 becomes more positive than the referenced voltage applied to input 62, one side of resistor 58 becomes grounded through comparator 60. This causes capacitor 54 to take longer to charge to a given voltage level, because some of the current from resistor 52 of the oscillator is being bled-off to ground via resistor 58. Therefore, the length of time during which the output at terminal 88 of oscillator 50 is at high condition is longer than it would be without the resistor 58. Conversely, the output at terminal 88 of oscillator 50 is at a low condition for a shorter time because both resistors 52 and 58 discharge capacitor 54 when the output at terminal 88 is at a low condition. The output at terminal 61 of comparator 60 is an open collector, so that when the plus (reference voltage) input 62 is higher than the minus input 68, the output at 61 is floating, and the effect on the oscillator is as if the resistor 58 were not there. The output of oscillator 50 is connected to the gate 96 of the power MOSFET 46 through the parallel-connected inverters 76, 78 and 80 to preferably provide increased drive capacity for to the MOSFET 46. By operating comparator 60 and oscillator 50 in conjunction with capacitor 54 as described above, the duty cycle of the MOSFET 46 is very accurately controlled. The outputs of the three inverters 76, 78 and 80 are high for a shorter time and low for a longer time, because the output of oscillator 60 is low for a shorter time and high for a longer time due to the input control circuit described above. Therefore, on-time for MOSFET 46 is shorter than its off-time as shown in FIG. 3*c*, which has the effect of reducing the total current through the MOSFET 46 and also the lamp 16.

Integrating capacitor 74 and resistor 72 average the current through resistor 44 with a time constant that is short compared to the duration of a half-cycle of 60 Hz a-c power. The voltage at the input 68 of comparator 60 is proportional to the current through resistor 44, and therefore, to the current through the MOSFET 46 and the lamp 16. The switching of the output at 61 of the comparator 60 is determined by the charging rate of capacitor 74, $V_C$ shown in FIG. 3*b*, which is dependent on the current through resistor 44 and MOSFET 46. Therefore, as shown in FIG. 3*c*, the duty cycle of the MOSFET 46 varies during each half-cycle of the line frequency inversely as the voltage across the lamp, i.e. the input $V_S$ to the MOSFET gate 96 is high for a shorter time as shown at $144_A$ when the voltage is high and is high for a longer time as shown at $144_B$ when the voltage is low, with the result that the average current flowing through the lamp is kept constant. If the current through resistor 44 is too high, the capacitor 74 quickly applies a signal to negative input 68 of comparator 60 causing the output of the comparator 60 to go to ground, thereby bleeding-off through resistor 58 some of the current which would normally be charging capacitor 54 through the resistor 52. This lengthens the on-time of oscillator 50 and the off-time of the MOSFET 46 and therefore the current through lamp 16, thereby reducing the average lamp current. In this fashion, the average current flowing through the lamp 16 is maintained constant regardless of the lamp voltage.

Figure 6A:
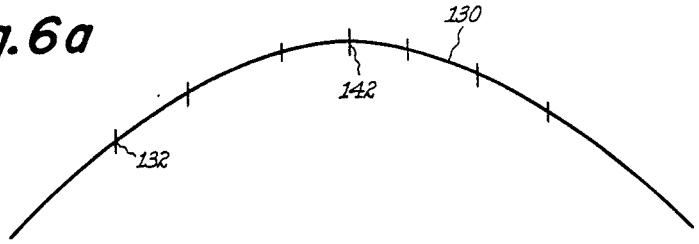
FIG. 6*a* is a waveform illustrating a sinusoidal input voltage.
Figure 6B:
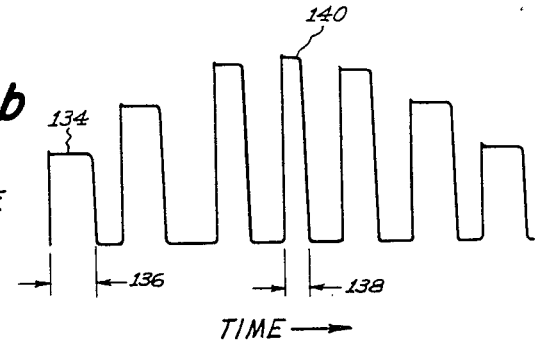
FIG. 6*b* is a waveform diagram illustrating the voltage pulses applied across the fluorescent lamp by the circuit shown in FIG. 1 at certain points in the waveform of FIG. 6*a;*
Figure 6C:
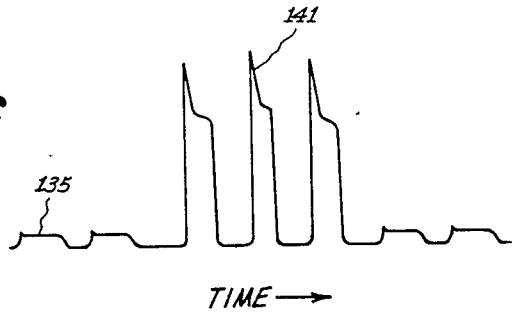
FIG. 6*c* is a waveform diagram illustrating the current pulses induced in the lamp by application of the voltage pulses shown in FIG. 6*b.

The waveforms for lamp voltage and current are shown in FIGS. 6*b* and 6*c*, respectively, for a sinusoidal input voltage shown partially at 130 in FIG. 6*a* as the input at terminals 12, and 14. The current through the lamp is proportional to the voltage across the lamp when the lamp is operating in the positive resistance portion 116 of the lamp characteristic. The oscillator 50 switches MOSFET 46 on and off at a high frequency, e.g. about 20 KHz, unless the comparator 60 forces a switching transition. When MOSFET 46 switches on at a high voltage level as shown at $145_C$ of FIG. 3*c*, the lamp current is high causing a high current through resistor 44 to charge the capacitor 74 to a positive voltage threshold in a shorter time as shown at $144_C$ of FIG. 3*b* than the oscillator's normal frequency to cause the comparator 60 to switch oscillator 50 and thereby turn off MOSFET 46 to interrupt lamp current after a shorter on-time interval.

As shown, when the lamp is switched on at a low voltage level 132 FIG. 6*a*, the voltage pulse 134 of FIG. 6*b* has a low amplitude and a longer duration 136 than the duration 138 of a voltage pulse 140 having a high amplitude resulting from the voltage level 142 of the input waveform 130 at the time of turn on. Similarly, the current pulse 135 has a low amplitude as compared to that of current pulse 141, but a much longer duration. At the lower voltage levels, the current through resistor 44 is too low to charge capacitor 74 to a voltage sufficient to switch comparator 60. Therefore, the lamp current is switched on and off at the oscillator frequency at low amplitude as shown by the current pulses 135 of FIG. 6*c*. In this manner lamp ionization charge is maintained essentially constant.

Figure 7:
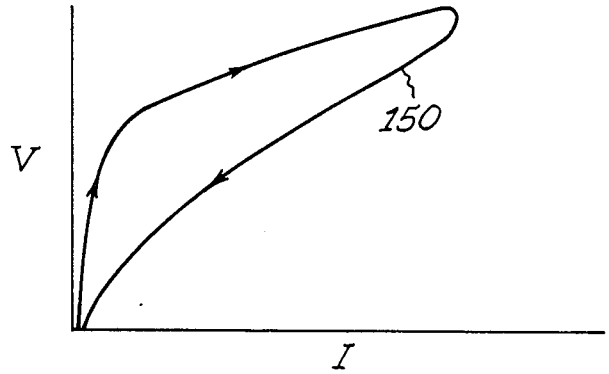
* and FIG. 7 is a diagram illustrating the lamp ionization regulation according to the present invention.

The ionization regulation follows the characteristic 150 shown in FIG. 7 for operation according to the present invention. It will be noted that no significant negative impedance region, in which voltage decreases as current increases, exists in FIG. 7. Lamp current limiting elements in the operating circuit are unnecessary and lamp regulation is simplified to a time controlled switching operation, because current and voltage are always proportional to each other.

We have discovered that if interrupt circuit switching time is decreased sufficiently, so that on-time is less than about 20 microseconds and off-time is less than about 100 microseconds, system efficacy improvements exceeding 50% are possible. This is due to three factors: (1) Contrary to observations for static operation and for operation in the runaway region for dynamically controlled systems, no penalty is incurred in positive column efficacy when operating a lamp using these high current pulses for short times. Apparently since very little ionization and deionization occur for on-times less than 20 microseconds, the losses associated with ion production are avoided. In fact, so little charge carrier production occurs that runaway may be controlled by controlling the charge (integral of the current) rather than by controlling peak current for each pulse; (2) By impressing line voltage across the lamp, the ratio of positive column drop to electrode drop is improved resulting in electrode loss reduction; and (3) Ballast efficiency improvements due to electronics provide a significant improvement in lamp efficiency compared to conventional systems. Therefore, the present invention provides a mechanism for regulating power supplied to electric discharge lamps without requiring energy storing current limiting devices such as a conventional electromagnetic ballast.

Although the hereinbefore discussion described lamp 16 as being a low pressure mercury vapor discharge lamp such as a fluorescent lamp, the practice of this invention is equally applicable to other lamps such as high pressure mercury lamps, high and low pressure sodium lamps, high and low pressure xenon lamps and metal halide lamps. For all contemplated applications, the operating of all lamps having an envelope capable of containing discharge gas atoms need only apply a voltage which is electrically connected in series with the related lamp and a current interrupt switch. The contemplated operations need only then control the duty cycle to the current interrupt switch so as to maintain a predetermined power level in the envelope of the related lamp in a manner as previously desired.

Further, although the hereinbefore discussion described the applied excitation as being of an a-c source, the practice of this invention contemplated the usage of an applied excitation from an d-c source. Similarly, the a-c applied excitation need not be limited to a sine-wave waveform in that it may have other shapes such as rectangular and saw-tooth.

It should now be appreciated that the present invention provides a circuit arrangement and a method for operating a discharge lamp that selectively controls the on-off times of the discharge lamp so as to advantageously maintain a predetermined ionization of discharge lamp.

What we claim as new and desire to secure by Letters patent of the United States is:

1. A method of operating gas discharge lamps comprising the steps of:

applying a voltage input connected electrically in series with a gas discharge lamp, having an envelope containing discharge gas atoms, and a current interrupt switch, said current interrupt switch controlling, on a periodic basis, the durations of the current flowing through the lamp, said durations having an on-time for ionization of said discharge gas atoms and an off-time for deionization of said discharge gas atoms, and controlling duty cycle or on-off times of said current interrupt switch in response to the amplitude of the input voltage connected to said gas discharge lamp, said off-times of said current interrupt switch having durations which vary inversely as said amplitude of said input voltage so as to maintain a predetermined power level in the envelope of said lamp by controlling the on-off times of said gas discharge lamp.

2. A method according to claim 1 wherein said gas discharge lamp is selected from the group consisting of a high pressure sodium discharge lamp, a low pressure sodium discharge lamp, a high pressure mercury lamp, a low pressure mercury lamp, a low pressure xenon lamp, a high pressure xenon lamp and a metal halide lamp.

3. A method according to claim 1 wherein said voltage is of a direct-current source.

4. A method according to claim 1 wherein said voltage is of a alternating-current source.

5. A method according to claim 1 wherein said voltage has a waveform shape selected from the group comprising a sine-wave, a rectangular and a saw-tooth.

6. A method for operating low pressure, gas discharge lamps having electrodes comprising the steps of:

applying a sinusoidal input waveform across a first pair of a-c terminals of a rectifier circuit connected electrically in series with a low pressure gas discharge lamp, having an envelope containing discharge gas atoms, and a current interrupt switch, said current interrupt switch controlling, on a periodic basis, the durations of the current flowing through the lamp, said durations having an on-time for ionization of said discharge gas atoms and an off-time for deionization of said discharge gas atoms, imposing a voltage upon the electrodes of the low pressure, gas discharge lamp to start said lamp;

imposing, by means of said current interrupt switch, a high frequency waveform across said lamp, said current interrupt switch having duty cycle or on-off times which are controlled in response to the amplitude of said sinusoidal input waveform, said off times of said current interrupt switch having durations which vary inversely as said amplitude of said input waveform, and controlling said duty cycle to maintain a predetermined level of ionization of discharge gas atoms within the envelope of said lamp by controlling the on-off times of said gas discharge lamp.

7. The method according to claim 6 wherein said imposed voltage is of a relatively high voltage and has a pulse-like shape.

8. The invention of claim 6 wherein said step of imposing a high frequency comprises:

imposing a sequence of electrical current pulses across the electrodes of said lamp.

9. The invention of claim 8 further comprising:

operating said gas discharge lamp in a positive resistance portion of the lamp current operating characteristic.

10. The invention of claim 8 wherein said step of controlling said duty cycle comprises:

applying and output of a controlled oscillator to a gate of a A.C. switch connected in series with said lamp to control the on-time of current flow through the lamp such the length of said on-time is less than or equal to one fifth of the lamp current off-time.

11. The invention of claim 10 wherein said A.C. switch is selected from the group comprising a power MOSFET, an Insulated Gate Transistor and a Darlington device.

12. The invention of claim 10 wherein:

said on-time comprises a time interval of less than 20 microseconds; and said off-time comprises a time interval of less than 100 microseconds

13. The invention of claim 12 wherein the step of controlling said duty cycle further comprises:

providing a switching input signal to the input of said oscillator which is dependent upon an integral condition of lamp current.

14. An electrical circuit for operating low pressure, mercury vapor gas discharge lamps comprising:

as rectifier circuit having a first pair of a-c terminals and a second pair of d-c terminals; one of said a-c terminals providing input means for connection to a source of alternating current (a-c) electrical power and the other of said a-c terminals providing means for series connection to at least one electrode of the low pressure, mercury vapor gas discharge lamp; and control circuit means connected across said second pair of d-c terminals comprising:

means for periodically interrupting the a-c current supplied to the lamp at a predetermined frequency higher that the frequency of said a-c electrical power said interrupting means further having means that provide durations which vary inversely as the amplitude of said source of alternating current, and determines duty cycle of said means for periodically interrupting and means for controlling the average current level of the a-c current through said lamp by controlling durations of the a-c current flowing through said rectifier circuit, said durations of current flow being controlled by the duty cycle or on-off times of said means for periodically interrupting A-C current supplied to said lamp.

15. The invention of claim 14 wherein said control circuit means further comprises:

a solid state switching device connected across said D-C terminals of said rectifier circuit;

an oscillator circuit connected to said switching device to supply on/off pulses at said predetermined frequency; and control means connected to said oscillator circuit switching for controlling the switching of said oscillator circuit in response to current flow through said solid state switching device, said switching control of said oscillator circuit providing said interrupt means with said durations which vary inversely as said amplitude of said source of alternating current.

16. The invention of claim 15 further comprising:

means for supplying a switching control input signal to said switching control device dependent upon an integral condition of the d-c current flowing through said solid state switching device, said means being a device having an impedance which follows the d-c current flow in an exponential manner.

17. The invention of claim 16 further comprising:

regulator means connected to the input of said oscillator circuit for controlling the duty cycle of said oscillator circuit.

18. The invention of claim 17 wherein said switching control device comprises:

comparator means having a first input for receiving a first input signal proportional to an integral condition of the current through said lamp and a second input for receiving a reference signal for comparing said first input signal and said second input signal and providing an output signal in response to said comparison to said oscillator circuit to control the state of said oscillator means.

19. The invention of claim 17 wherein said regulator means further comprises:

a charge storage capacitor for controlling the input voltage at the input of said oscillator circuit; and discharge means for controlling the rate of charging and discharging of said charge storage capacitor.

20. The invention of claim 19 further comprising:

variable resistance means having a tap connected to said second input of said comparator means and for providing said reference signal; and power supply means connected to said variable resistance means for supplying a d-c signal of predetermined voltage to said variable resistance means.

21. The invention of claim 15 wherein said solid state switching device comprises:

a power MOSFET having a gate terminal connected to the output of said oscillator circuit, a drain terminal connected to one of said d-c terminals of said rectifier circuit and a source terminal connected to said means for supplying a switching control input signal.

22. The invention of claim 14 wherein:

said duration of the a-c current flowing through said rectifier current has an off-time which comprises a time interval less than 30 microseconds; and said duration of the a-c current flowing through said rectifier current has an on-time which comprises a time interval of less than 3.0 microseconds.

* * * * *